US005209655A

United States Patent [19]

Geary

[11] Patent Number: 5,209,655

[45] Date of Patent: May 11, 1993

[54] HEAT EXCHANGER SYSTEM, FUEL CONTROL SYSTEM THEREFOR, AND METHODS OF MAKING THE SAME

[75] Inventor: Frederick J. Geary, Holland, Mich.

[73] Assignee: Robertshaw Controls Company, Richmond, Va.

[21] Appl. No.: 900,891

[22] Filed: Jun. 18, 1992

Related U.S. Application Data

[62] Division of Ser. No. 816,400, Dec. 27, 1991, Pat. No. 5,141,431.

[51] Int. Cl.[5] ..... F23N 5/20

[52] U.S. Cl. ..... 431/6; 431/31; 431/46

[58] Field of Search ..... 431/6, 31, 46, 70, 71, 431/73, 74

[56] References Cited

U.S. PATENT DOCUMENTS 4,192,641 3/1980 Nakagawa et al. ..... 431/31
4,836,770 6/1989 Geary ..... 431/46
4,856,983 8/1989 Geary ..... 431/27
4,971,549 11/1990 Geary ..... 431/46
4,976,605 12/1990 Geary ..... 431/27

*Primary Examiner*—Carroll B. Dority
*Attorney, Agent, or Firm*—Candor, Candor & Tassone

[57] ABSTRACT

A heat exchanger system, a fuel control system therefor and methods of making the same are provided, the fuel control system having an electrical circuit means that comprises an ignition trial portion, a flame sensing control portion and a timer portion that comprises a counter having a plurality of outputs and a timer that clocks the output of the counter on each discharge of the timer, the timer portion also comprising a capacitor, a trial time resistor and a wait time resistor that are selectively placed in series with the capacitor by the counter when clocked to certain outputs by the timer to determine an ignition trial time period and a wait time period.

12 Claims, 6 Drawing Sheets

HEAT EXCHANGER SYSTEM, FUEL CONTROL SYSTEM THEREFOR, AND METHODS OF MAKING THE SAME

CROSS REFERENCE TO RELATED APPLICATION

This application is a divisional patent application of its copending parent patent application, Ser. No. 816,400 filed Dec. 27, 1991 and now U.S. Pat. No. 5,141,431.

BACKGROUND OF THE INVENTION

1. Field of the Invention

This invention relates to a new heat exchanger system and to a new fuel control system for such a heat exchanger system as well as to new methods of making such a heat exchanger system and such a fuel control system.

2. Prior Art Statement

It is known to provide a fuel control system for a heat exchanger system that comprises a thermostat, burner means, and electrically operated igniter means for igniting fuel that issues from the burner means, the fuel control system comprising electrical circuit means that comprises an ignition trial portion for operating the igniter means, a flame sense control portion for operating the burner means, and a timer portion adapted on each cycle of closing of the thermostat and before the next opening thereof to cause the ignition trial portion to tend to operate the igniter means for a first certain period of trial time, said flame sense control portion being adapted to terminate the operation of the igniter means during the first certain period of trial time if the flame sense portion senses that fuel issuing from the burner means has been ignited, the timer portion being adapted to terminate the operation of the igniter means upon the termination of the first certain period of trial time if no flames appear at the burner means and to provide a first certain period of wait time before causing the ignition trial portion to tend to operate the igniter means for a second certain period of trial time during that cycle, the flame sense control portion being adapted to terminate the operation of the igniter means during the second certain period of trial time if the flame sense control portion senses that fuel issuing from the burner means has been ignited. For example, see the Geary, U.S. Pat. No. 4,976,605.

For similar fuel control systems, see the Geary U.S. Pat. Nos. 4,836,770; 4,856,983 and 4,971,549.

Also see Chapter 8, pages 155–173 of the book, *IC Timer Hand Book With One Hundred Projects And Experiments* by Joseph J. Carr, published by Tab Books Inc. in 1981 for various applications of such a counter.

SUMMARY OF THE INVENTION

It is one of the features of this invention to provide a new fuel control system for a heat exchanger system wherein unique timing means is provided to permit a different total time for an ignition trial period than the total time provided for a wait period between two trial ignition trial times.

In particular, the prior known fuel control system of the aforementioned Geary, U.S. Pat. No. 4,976,605 will provide either a thirty-four second or seventeen second ignition trial time and a respective thirty-four second or seventeen second wait time between the trial times.

However, it was found according to the teachings of this invention that an IC timer and an IC counter can be uniquely arranged in a timer portion of an electrical circuit means so as to have a first output of the counter place trial time resistor means in series with a capacitor that controls the discharge of the timer for clocking the counter and establishing an ignition trial time period and for having another output for placing wait time resistor means in series with that capacitor for establishing a different wait time period between first and second ignition trial time periods.

For example, one embodiment of this invention comprises a fuel control system for a heat exchanger system that comprises a thermostat, burner means, and electrically operated igniter means for igniting fuel that issues from the burner means, the fuel control system comprising electrical circuit means that comprises an ignition trial portion for operating the igniter means, a flame sense control portion for operating the burner means, and a timer portion adapted on each cycle of closing of the thermostat and before the next opening thereof to cause the ignition trial portion to tend to operate the igniter means for a first certain period of trial time, the flame sense control portion being adapted to terminate the operation of the igniter means during the first certain period of trial time if the flame sense control portion senses that fuel issuing from the burner means has been ignited, the timer portion being adapted to terminate the operation of the igniter means upon the termination of the first certain period of trial time if no flames appear at the burner means and to provide a first certain period of wait time before causing the ignition trial portion to tend to operate the igniter means for a second certain period of trial time during that cycle, the flame sense control portion being adapted to terminate the operation of the igniter means during the second certain period of trial time if the flame sense control portion senses that fuel issuing from the burner means has been ignited, the timer portion comprising a counter having a plurality of outputs and a timer that clocks the output of the counter on each discharge of the timer, a capacitor for causing the timer to discharge and discharge the capacitor to a discharged condition thereof upon each charging of the capacitor to a certain voltage, trial time resistor means, and wait time resistor means, the counter when clocked to a first output thereof by the timer being adapted to place the trial time resistor means and the capacitor in series at the start of the first trial time period so that the trial time resistor means determines the time period the capacitor charges from its discharged condition to the certain voltage thereof and that time period comprises the first certain trial time period, the counter when clocked to a second output thereof by the timer being adapted to place the wait time resistor means and the capacitor in series at the start of the wait time period so that the wait time resistor means determines the time period the capacitor charges from the discharged condition thereof to the certain voltage thereof and that time period comprises the wait time period, the counter when clocked to a third output thereof by the timer being adapted to place the trial time resistor means and the capacitor in series at the start of the second trial time period so that the trial time resistor means determines the time period the capacitor charges from its discharged condition to the certain voltage thereof and that time period comprises the second certain trial time period.

Accordingly, it is an object of this invention to provide a new heat exchanger system having one or more of the novel features of this invention as set forth above or hereinafter shown or described.

Another object of this invention is to provide a new method of making such a heat exchanger system, the method of this invention having one or more of the novel features of this invention as set forth above or hereinafter shown or described.

Another object of this invention is to provide a new fuel control system for such a heat exchanger system, the fuel control system of this invention having one or more of the novel features of this invention as set forth above or hereinafter shown or described.

Another object of this invention is to provide a new method of making such a fuel control system, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

BRIEF DESCRIPTION OF THE DRAWINGS

FIG. 2A illustrates part of the heat exchanger system and part of the fuel control system of this invention.

FIG. 2B illustrates part of the heat exchanger system and part of the fuel control system of this invention.

FIG. 2C illustrates part of the heat exchanger system and part of the fuel control system of this invention.

FIG. 2D illustrates part of the heat exchanger system and part of the fuel control system of this invention.

FIG. 2E illustrates part of the heat exchanger system and part of the fuel control system of this invention.

FIG. 2F illustrates part of the heat exchanger system and part of the fuel control system of this invention.

DESCRIPTION OF THE PREFERRED EMBODIMENT

Figures 1, 2A:
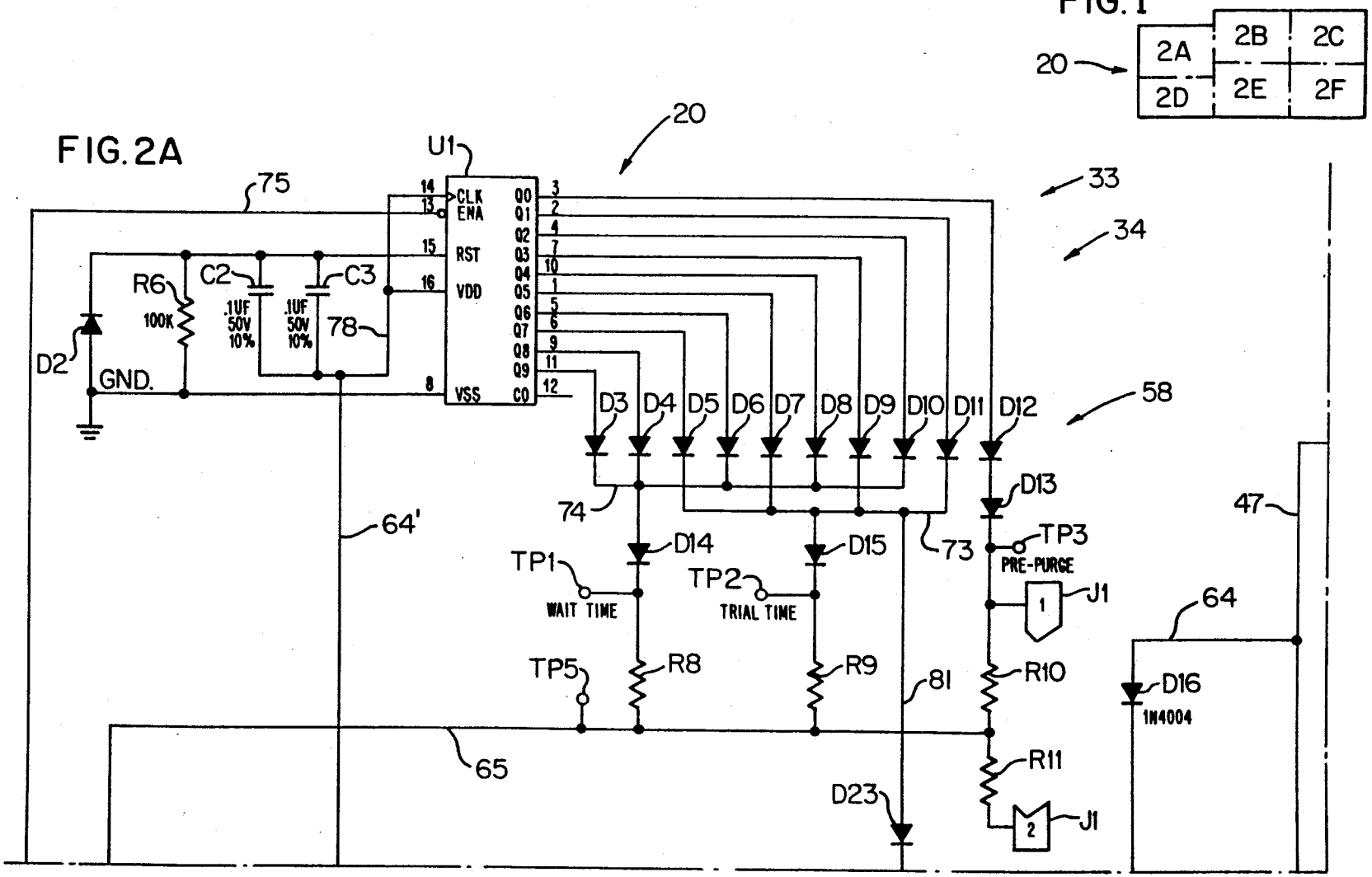
FIG. 1 is a schematic view illustrating how
FIGS. 2A, 2B, 2C, 2D, 2E and 2F are to be positioned relative to each other in order to illustrate the entire heat exchanger system of this invention as well as the entire fuel control system of this invention.

While the various features of this invention are hereinafter illustrated and described as being particularly adapted to provide a fuel control system for controlling the operation of a spark intermittent pilot arrangement, it is to be understood that the various features of this invention can be utilized singly or in various combinations thereof to provide a fuel control system for other ignition arrangements as desired, such as for a direct spark ignition arrangement, a hot surface intermittent pilot arrangement, a direct hot surface ignition means, etc.

Therefore, this invention is not to be limited to only the embodiment illustrated in the drawings, because the drawings are merely utilized to illustrate one of the wide variety of uses of this invention.

Figure 2B:
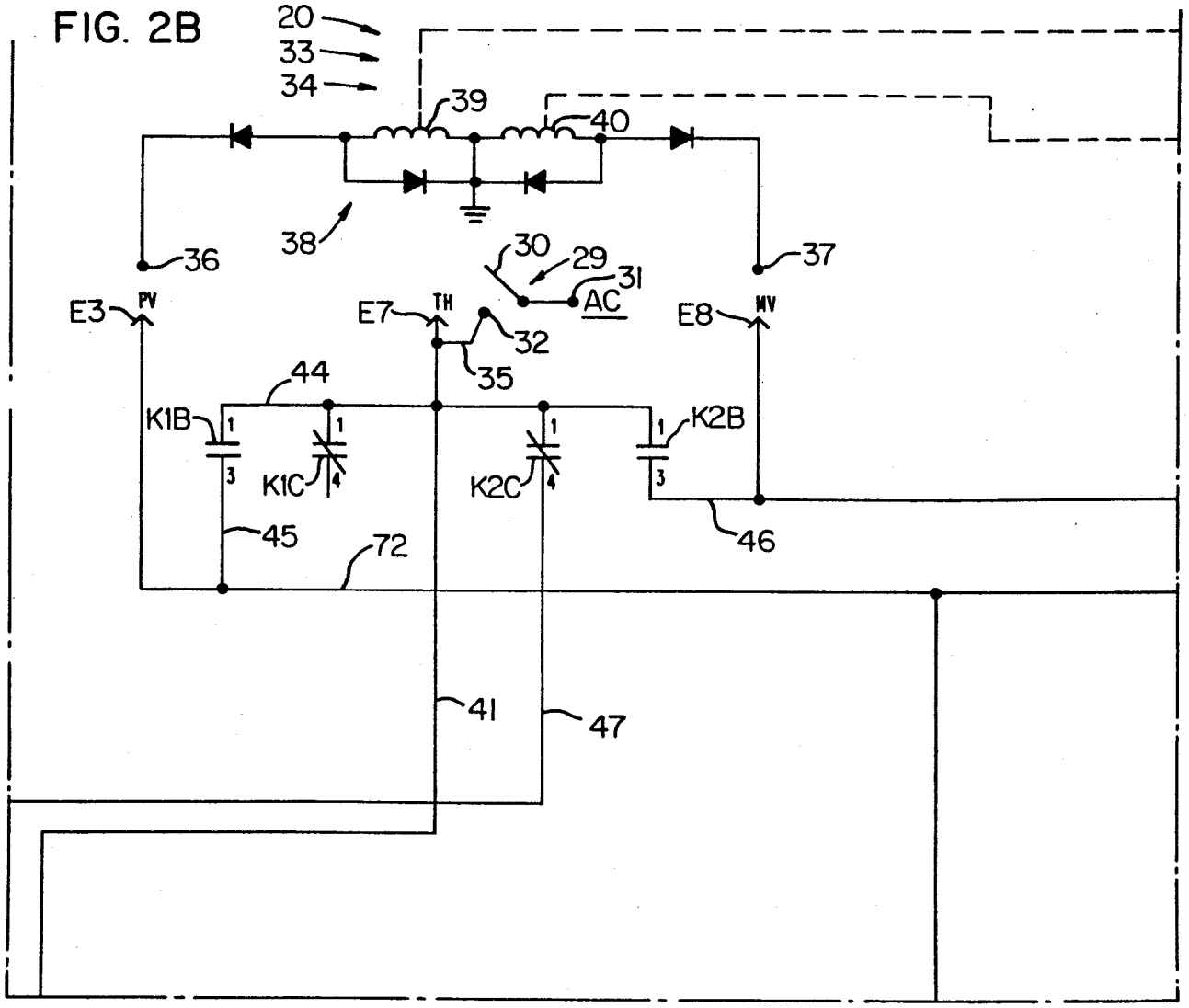
Figure 2C:
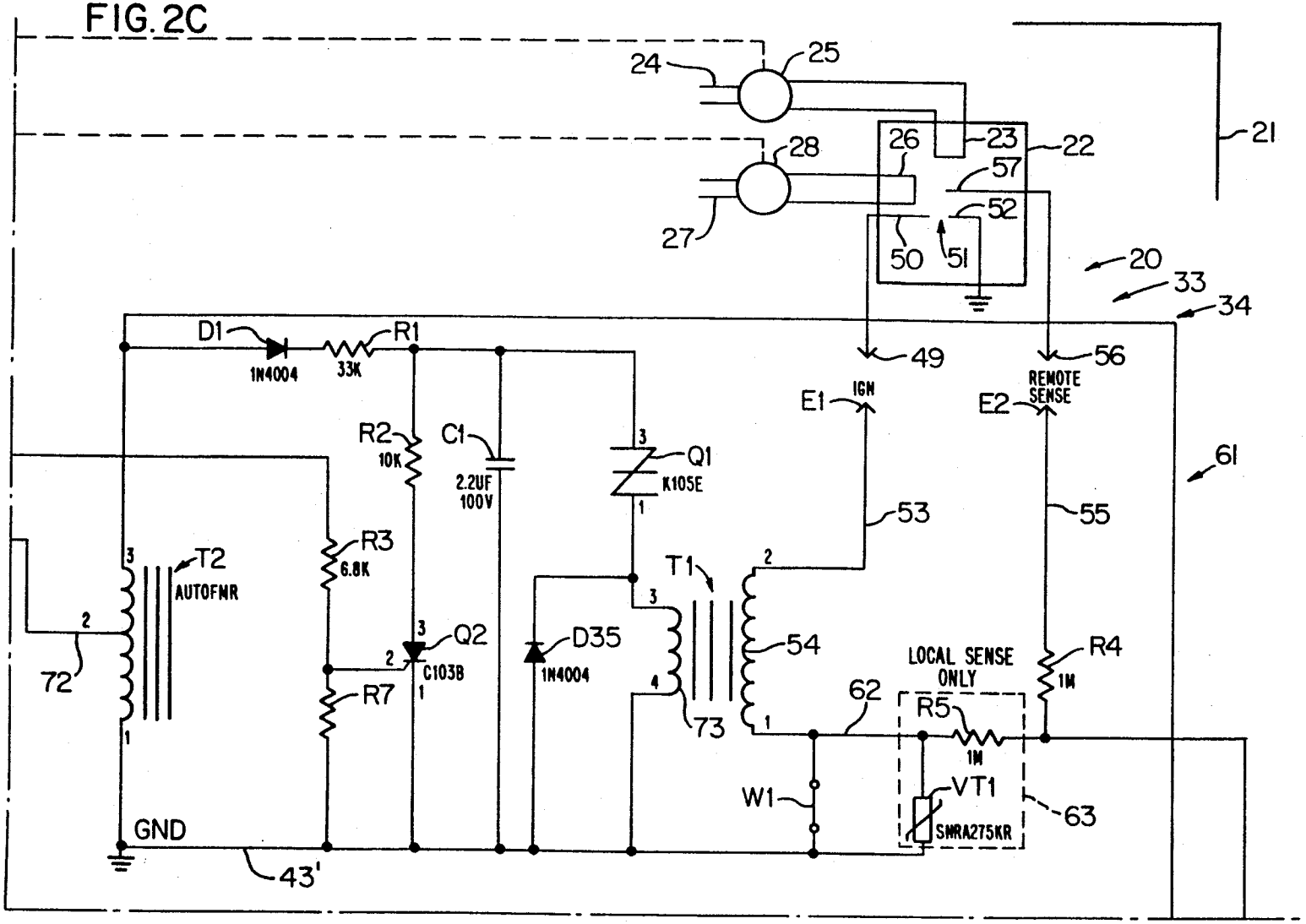

Referring now to the drawings, the new heat exchanger control system of this invention is generally indicated by the reference numeral 20 and comprises the structure illustrated in FIGS. 2A–2F that are to be placed together in the manner illustrated in FIG. 1, the heat exchanger fuel control system 20 being utilized to control the operation of a gas burning furnace that is represented by the reference numeral 21 in FIG. 2C and having a combustion chamber as represented by the reference numeral 22 in FIG. 2C.

As illustrated in FIG. 2C, the system 20 of this invention comprises a pilot burner means 23 that issues fuel therefrom that is directed thereto from a fuel source conduit means 24 when an electrically operated pilot valve means 25 is opened. Similarly, a main burner means 26 is provided and is adapted to issue fuel therefrom that is directed thereto from a fuel source conduit 27 when an electrically operated main valve means 28 is opened, the fuel issuing rom burner means 26 to be ignited by the flames of the burning fuel issuing from the pilot burner means 23 so that the burning fuel issuing from the main burner means 26 will heat the combustion chamber 22 in a manner well known in the furnace art for supplying heated air to a desired location or locations when a thermostat that is generally indicated by the reference numeral 29 in FIG. 2B determines that the furnace 21 should supply such heated air.

Of course, when the thermostat 29 is disposed in the open condition as illustrated in FIG. 2C, the system 20 prevents any fuel from issuing from the main burner means 26 as well as from the pilot burner means 23 as will be apparent hereinafter. The thermostat 29 is schematically illustrated in FIG. 2B as having a movable switch blade 30 that is electrically interconnected to one side 31 of an alternating current source AC, such as that commonly supplied by a transformer that delivers 24 volts AC. The switch blade 30 is adapted to be into electrical contact with a fixed contact 32 when the thermostat 29 senses a temperature below the set point temperature of the thermostat so as to demand heat from the furnace 21 all in a manner well known in the art.

The heat exchanger system 20 of this invention comprises a fuel control system of this invention that is generally indicated by the reference numeral 33 in FIGS. 2A–2F and comprises an electrical circuit means that is generally indicated by the reference numeral 34 in FIGS. 2A–2F.

The electrical circuit means 34 has a terminal E7, FIG. 2B, that is adapted to be interconnected to the fixed contact 32 of the thermostat 29 by an electrical lead 35 whereby the alternating current source AC from the transformer that is electrically interconnected to the switch blade 30 of the thermostat 29 is adapted to be interconnected to the circuit means 34 when the thermostat 29 is in a closed condition so as to power the electrical circuit means 34 all in a manner well known in the art and as fully illustrated by the electrical lines set forth in FIGS. 2A–2F whereby the individual electrical lines and their interconnection need not be fully set forth as the same are obvious from the drawings.

In addition, it can be seen from the drawings that the various components of the electrical circuit means of this invention are respectively given reference characters that are common in the art to represent the component, such as C for a capacitor, R for a resistor, D for a diode, Q for a transistor, SCR, etc., with each capital letter thus being followed by a numerical number to distinguish that particular reference letter from the others of a similar component. Therefore, only the components believed necessary to fully understand the various features of this invention will be hereinafter specifically mentioned.

The electrical circuit means 34 as illustrated in FIG. 2B comprises two terminals E3 and E8 which are adapted to be respectively interconnected to terminals 36 and 37 of a control valve unit that is generally indicated by the reference numeral 38 and has a first electrical coil means 39 for causing the pilot valve means 25 to open when electrical current flows through the coil means 39 and a second coil means 40 for causing the main valve means 28 to open when an electrical current flows through the coil means 40 all in a manner well known in the art. For example, see the Kelly, U.S. Pat. No. 4,610,269, which discloses such a control valve unit whereby this U.S. patent is being incorporated into this disclosure by this reference thereto.

Figure 2D:
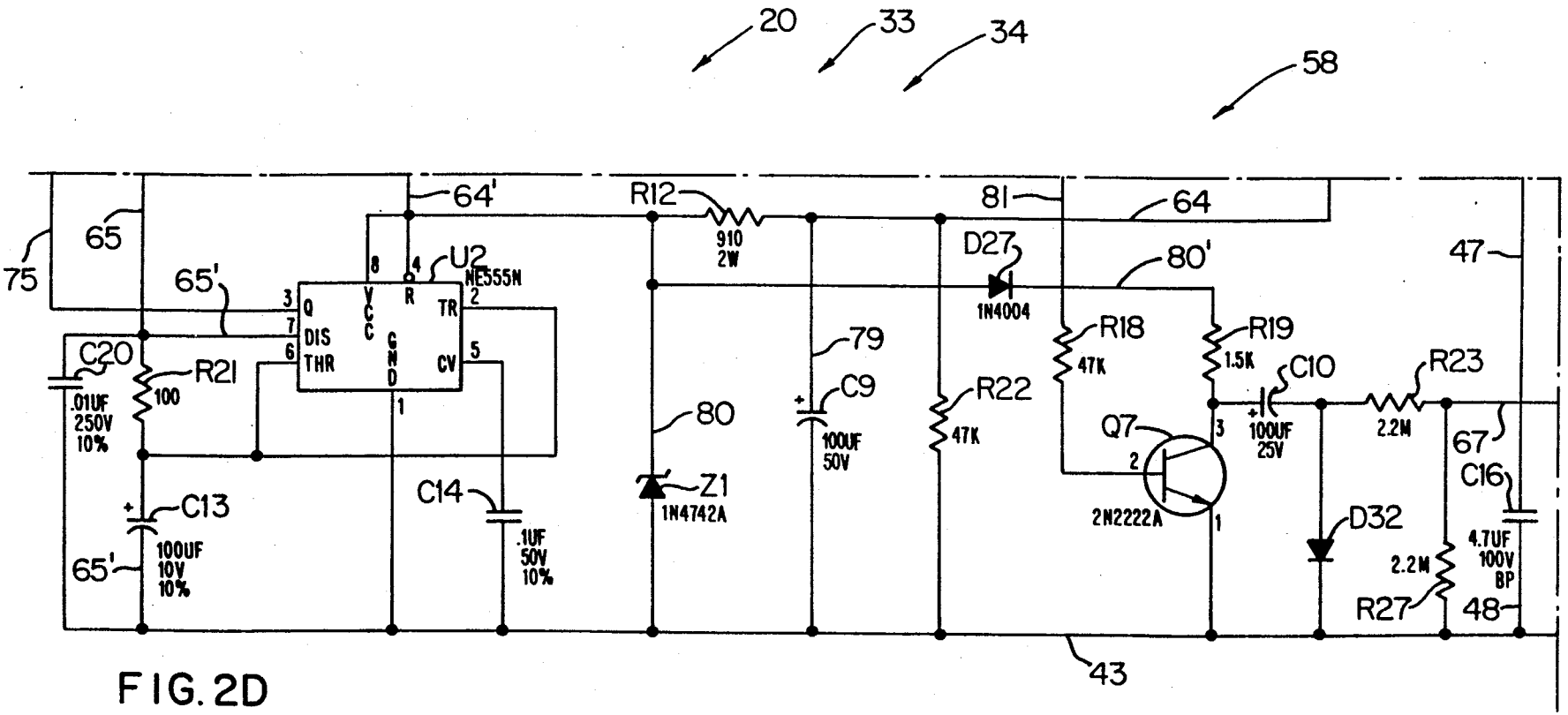
Figure 2E:
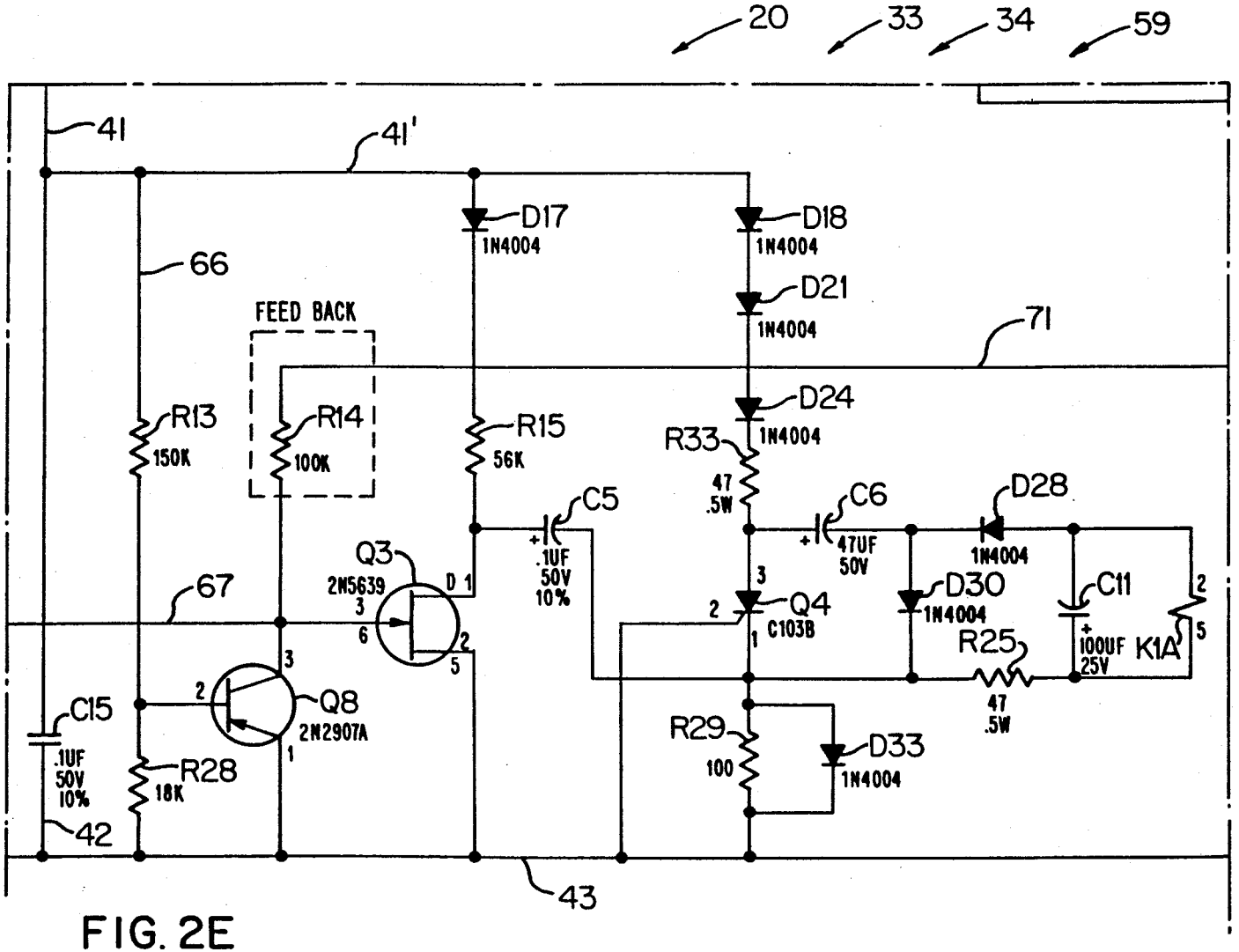

Thus, it can be seen in FIG. 2B that the lead 35 from the contact 32 of the thermostat 29 interconnects with a lead means 41 of the electrical circuit means 34 which is interconnected to one side of a capacitor C15, FIG. 2E, while the other side of the capacitor C15 is interconnected by a lead 42 to a ground lead means 43 of the circuit means 34 as illustrated.

The lead 41 from the also interconnected to a lead means 44 of the circuit means 34 which is interconnected to a contact 1 of normally open relay contact means K1B and to a contact 1 of normally open relay contact means K2B. The other contacts 3 of the normally open relay contact means K1B and K2B are respectively interconnected by lead means 45 and 46 of the electrical circuit means 34 to the terminals E3 and E8 and, thus, respectively to one side of the coil means 39 and 40 of the control valve unit 38 which has the other sides thereof interconnected to ground as illustrated in FIG. 2B.

In this manner, when the thermostat 29 is in a closed condition and a relay coil K1A, FIG. 2E, is energized in a manner hereinafter set forth, the relay contacts K1B close and thereby interconnect the power source lead 41 of the circuit means 34 to the coil means 39 which will cause the pilot control valve means 25 to open so that fuel can issue from the pilot burner means 23.

Similarly, when an electrical current is caused to flow through a relay coil means K2A, FIG. 2F, in a manner hereinafter set forth, the normally open relay contact means K2B close and thereby electrically interconnect the power source lead means 41 of the electrical circuit means 34 to the terminal E8 and thus permit current to flow through the coil 40 and thereby cause the main burner valve means 28 to open and permit fuel to issue from the main burner means 26.

The closing of the normally open contacts K2B upon the energizing of the coil K2A causes normally closed relay contacts K2C, FIG. 2B, to open and thereby disconnect the lead means 41 from a lead means 47 that interconnects to one side of a capacitor C16 that has the other side interconnected by a lead 48 to the ground lead means 43 as illustrated.

The electrical circuit means 34 has a terminal E1, FIG. 2C, that is interconnected to a terminal 49 of a probe 50 that is adapted to spark across a gap 51 to a ground probe 52 when a sparking potential is applied to the terminal E1 by a lead means 53 that is interconnected to the side 2 of a secondary coil 54 of a transformer T1 that is energized in a manner hereinafter set forth.

The electrical circuit means 34 comprises a terminal E2, FIG. 2C, that is interconnected to a lead 55 of the electrical circuit means 34 and to a terminal 56 of a flame sensing probe 57 that is adapted to sense flame means at the pilot burner means 23 through flame rectification and thereby apply a negative potential through resistors R4, R20 and R24 to the gate 3 of a field effect transistor Q6 of FIG. 2F for a purpose hereinafter set forth.

In general, the electrical circuit means 34 of this invention can be divided into various portions thereof which, of course, are operatively interconnected together as illustrated but have separate functions.

In particular, the electrical circuit means 34 has a timer portion that is generally indicated by the reference numeral 58 and generally comprises the part of the circuit means 34 that is illustrated in FIGS. 2A and 2D.

The electrical circuit means 34 has an ignition trial portion that is generally indicated by the reference numeral 59 in FIG. 2E.

Figure 2F:
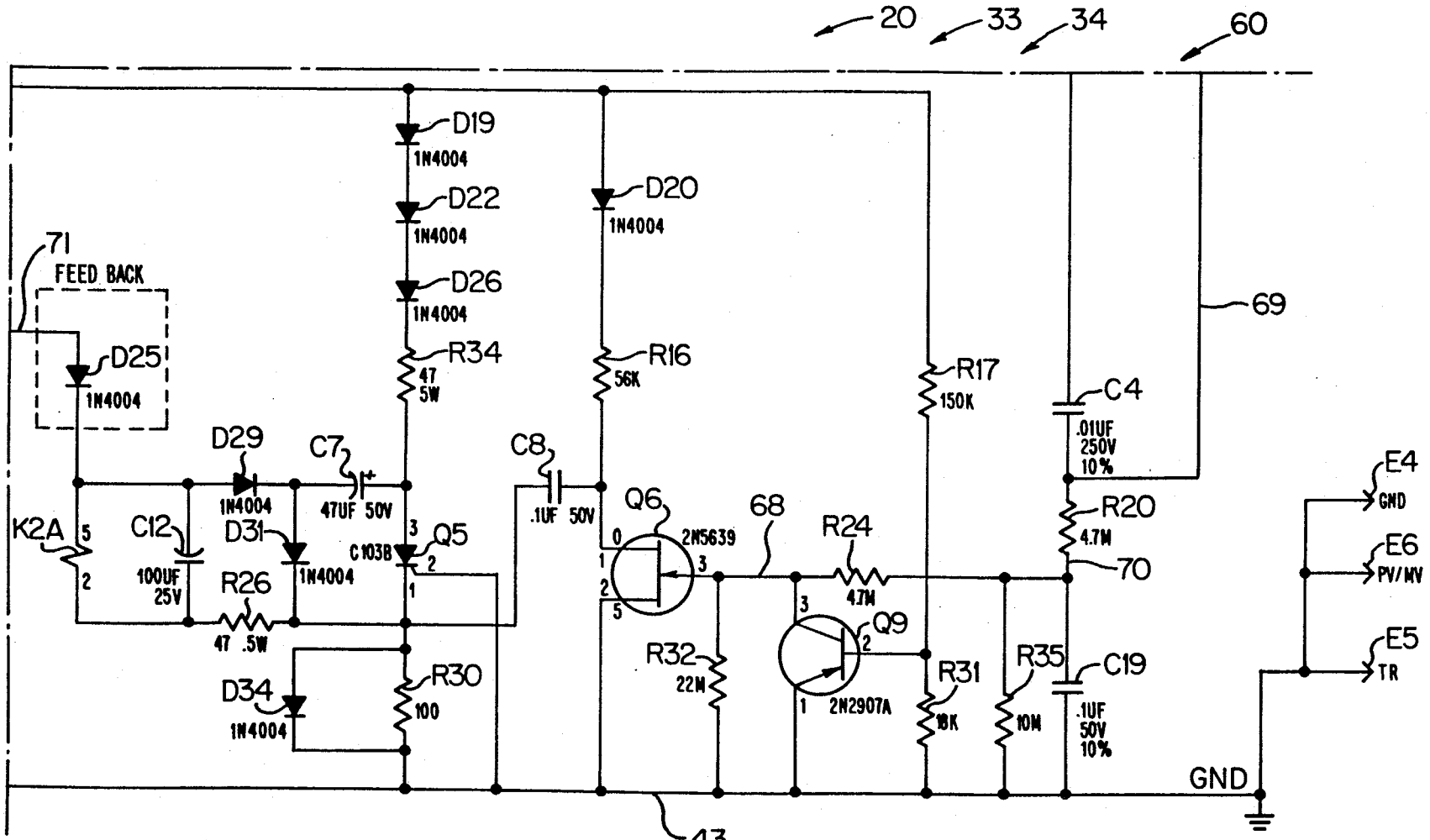

The electrical circuit means 34 has a flame sense control portion that is generally indicated by the reference numeral 60 in FIG. 2F.

In addition, the electrical circuit means 34 has an ignition portion that is generally indicated by the reference numeral 61 in FIG. 2C for causing sparking across the spark gap 51.

The ignition portion 61 of the electrical circuit means 34 when utilizing the remote sense probe 57 as illustrated in the drawings has lead 56 interconnected to the lead 55 through the terminal E2 and, thus, through the resistor R4 to the line 69. The side 1 of the secondary winding 54 of the transformer T1 is interconnected to the lead 43' by the jumper W1 that does not have the resistor R5 therein nor the varistor VT1 whereby the jumper W1 and the resistor R4 are removed and the parts R5 and VT1 are utilized in the ignition portion 61 when the sparking probe 50 is to be utilized as a local flame sense probe thus interconnecting the line 62 to the line 69 through the resistor R5 and the line 62 to the line 43' through the varistor VT1. Therefore, the parts R5 and VT1 in FIG. 2C are indicated as being in an option box 63 which is only inserted in the electrical circuit means 34 when a local flame sense is to be utilized but since the system 20 of this invention will be described as operating with the remote sense probe 57, the parts R5 and VT1 of the box 63 are removed and the line 62 goes directly to the line 43' through the jumper W1 and the line 55 interconnects to the line 69 through the resistor R4.

The timing portion 58 of the electrical circuit means 34 of this invention is unique in that it comprises an IC timer U2, a decade IC counter U1, a capacitor C13, a prepurge resistor means R10, a trial time resistor means R9 and a wait-time resistor means R8 all arranged in a manner hereinafter set forth so that the resistor means R10, R9 and R8 are each adapted to be disposed in series with the capacitor C13 to provide different time periods for the systems 20 and 33 as will be apparent hereinafter.

The timer portion 58 illustrated in FIGS. 2A and 2D is arranged so that on each cycle of operation of the thermostat 29 where the switchblade 30 is moved from an open condition thereof to a closed condition and remains closed until subsequently opened to terminate that one cycle of operation thereof, to initially provide a prepurge wait-time period before the ignition trial portion 59 attempts to have an ignition cycle of operation. The timer portion 58 is then adapted to provide a first ignition trial period for a certain period of time and, if the flame sense control portion 60 of the circuit means 34 does not detect a flame means, the timer portion 58 will cause the ignition trial portion 59 to terminate its operation and then wait for the lapsing of a particular wait-time period before the ignition trial portion 59 is again energized in an attempt to provide an ignition.

During each cycle of operation of the thermostat 29, the timer portion 58 of the circuit means 34 is adapted to try for four ignition trials each with a wait-time period between each of the four trials and then after the fourth ignition trial period and, if the timer portion 58 is not arranged for a lockout option, the timer portion 58 will wait for twice the wait-time period before again having a trial ignition period and then go through three more of those trial ignition periods with intervening wait-time periods before again waiting for twice the wait-time period before repeating that cycle of operation over and over again as long as that thermostat 29 is in its closed condition for that particular cycle of operation thereof.

However, when the thermostat 29 opens, the timer portion 58 of the electrical circuit means 34 is reset so that upon the next closing of the thermostat 29, the timer portion 58 will provide a prepurge wait-time period if such option has been provided and then provide the ignition trial times and intervening wait periods as previously described until ignition is sensed by the flame sense control portion 60 because once the flame sense control portion 60 senses a flame at the pilot burner means 23, the flame sense control portion 60 will cause the timer portion 58, the ignition trial portion 59 and the igniter portion 61 to cease the operation thereof until the next cycle of operation of the thermostat 29 as will be apparent hereinafter.

With the circuit means 34 being in the condition illustrated in the drawings, it can be seen that on the initial closing of the thermostat 29, the now energized power lead means 41 is interconnected by the normally closed relay contact means K2C to the lead means 47 that is interconnected by a lead means 64 through a diode D16, a resistor R12, a diode D27 and a resistor R18 to the collector 3 of a transistor Q7, to the input 8 of the timer U2 and through the lead means 64' to the input 14 of the counter U1 which is turned on by the current now reaching the input 14 thereof. The turned on counter U1 now interconnects current to the output Q0 which leads to a diode D12 and through a diode D13 and the resistor means R10 to a lead means 65 that leads to the positive side of the capacitor C13 that has the negative side thereof interconnected by a lead means 65' to the ground lead means 43 as illustrated.

In general, the ignition trial portion 59, the flame sense control portion 60 and the ignition portion 61 of the electrical circuit means 34 of the system 20 of this invention are similar to such portions of the electrical circuit means of the aforementioned Geary, U.S. Pat. Nos. 4,836,770; 4,856,983; 4,971,549 and 4,976,605, whereby these four U.S. patents are being incorporation into this disclosure by this reference thereto.

Also, since the structure and operation of the IC timer U2 and IC counter U1 are well known and are respectively disclosed in chapters 5–7 and chapter 8 of the aforementioned book, *IC Timer Handbook* that was published in 1981 by Tab Books, Inc., these four chapters are also being incorporated into this disclosure by this reference thereto.

As is well known from the aforementioned four U.S. patents to Geary, the transistor Q3 of the ignition trial portion 59 is a field effect transistor which is always conducting between its pins 1 and 2 if it does not have a negative voltage impressed upon its gate 3. However, as soon as a negative voltage is impressed upon the gate 3 of the transistor Q8, the transistor Q3 goes into a nonconducting status just like opening a switch so that the voltage felt on its drain or pin 1 goes up to the applied voltage which is fed thereto from the lead means 41, lead means 41', diode D17 and resistor R15. When that negative voltage is removed from the gate 3 of the transistor Q3, the transistor Q3 begins to conduct again so that the voltage on pin 1 thereof drops to a very low level. In this manner, by putting a negative voltage on the gate 3 of the transistor Q3, the voltage on the drain or pin 1 of the transistor Q3 can raise and then by removing this negative voltage on the gate 3 of the transistor Q3, the voltage on the pin 1 drops back down to a very low value.

The above cycling action of the transistor Q3 is a dynamic change and the ignition trial portion 59 of the circuit means 34 responds to this dynamic change. However, in order to continuously apply a negative voltage and then remove that negative voltage from the gate 3 of the transistor Q3, a transistor Q8 is provided in the ignition trial portion 59 and has its collector 3 electrically interconnected to the gate 3 of the transistor Q3 while the gate 2 of the transistor Q8 is interconnected between the power source lead means 41' and the ground lead means 43 as illustrated in FIG. 2D.

A negative voltage is adapted to be imposed on the gate 3 of the transistor Q3 by a lead means 67 of the electrical circuit means 34 in a manner hereinafter set forth.

Thus, every time the AC cycle that is imposed on the gate 2 of the transistor Q8 by the line means 66 goes below ground, it turns the transistor Q8 on and thereby dumps the negative voltage signal on the gate 3 of the transistor Q3 to ground so that the transistor Q3 begins to conduct again. As soon as the negative half cycle of the AC signal imposed on the gate 2 of the transistor Q8 by the lead means 66 comes back to zero and begins in its positive direction, the transistor Q8 stops conducting and the negative voltage then can be reapplied to the gate 3 of the transistor Q3 through the lead means 67 in a manner hereinafter set forth so that the transistor Q3 can go into its nonconducting state i.e., it turns off and no longer conducts. So essentially, by putting a negative halfway cycle into the transistor Q8, the same is creating a square wave signal out of the transistor Q3 i.e., the transistor Q3 is either on/off, on/off, etc., so that the transistor Q3 is off every time the negative half of the AC cycle is applied to the gate 2 of the transistor Q8 and the transistor Q3 is on or conducts every time that negative half of the AC cycle is taken away.

In this manner, when a negative voltage is permitted to be applied to the gate 3 of the transistor Q3 so that the transistor Q3 does not conduct, a capacitor C5 charges up from the ground lead means 43, through the diode D33 and through the resistor R15, the diode D17 and the lead means 41' to the power source lead 41 whereby the capacitor C5 is charged on the positive half of the AC cycle that is applied to the gate 2 of the transistor Q8. However, when the negative half cycle comes along and turns on the transistor Q8 which removes the negative voltage from the gate 3 of the transistor Q3, the transistor Q3 goes into a conducting state and, therefore, capacitor C5 is practically placed to ground so that capacitor C5 will have to discharge and its discharge is through the cathode of a gate terminal 2 of a SCR Q4 back to the ground lead means 43 and up through pin 2 of transistor Q3 and pin 1 of transistor Q3 to the positive side of the capacitor C5. In this manner, the capacitor C5 has been able to charge on the positive half cycle of the AC signal and then on the negative half cycle of the AC signal the capacitor C5 is allowed to discharge in a way that will turn on the SCR Q4.

The SCR Q4 is a similar type circuit in that it allows a capacitor C6 to also charge on the positive half cycle and this charge takes place through the diode D33, a diode D30 and the negative side of the capacitor C6 through a resistor R33 and the three series diodes D24, D21 and D18 and the lead means 41' to the power source lead means 41.

Thus, assume that the capacitor C5 and the capacitor C6 charge on the positive half cycle. Then on the negative half cycle, the capacitor C5 discharges and turns on the SCR Q4 and when the SCR Q4 turns on, the SCR Q4 practically shorts the capacitor C6 to pin 1 of the SCR Q4. The capacitor C6 then discharges through a diode D28, a capacitor C11 and a resistor R25 back to the positive side of the capacitor C6 so all of the energy that is in the capacitor C6 is transferred over to the capacitor C11. This energy is enough to pull in or energize the relay coil K1A and hold it in or energized in the remainder of the cycle while the SCR Q4 is turned off and recharging. The relay coil K1A will still be held in during the recharging of the SCR Q4 because of the discharging of the capacitor C11 through the relay coil K1A during such recharging.

In this manner, the ignition trial portion 59 is adapted to charge the capacitors thereof up on the positive half cycle of the AC signal in lead means 66 and to discharge the capacitors during the negative half cycle of that AC signal so that the relay coil K1A will be continuously energized. However, if at any time should any component of the ignition trial portion 59 of the electrical circuit means 34 be open or short, the relay coil K1A will not pull in.

So in essence, the ignition trial portion 59 is arranged so that a negative signal coming in on the gate 3 of the transistor Q3 will be continually dumped by the transistor Q8 at a 60-cycle rate that will pull in or energize in the relay coil K1A.

When the relay coil K1A is pulled in or energized in the above manner, the energized relay coil K1A closes the normally open relay contact means K1B for a purpose hereinafter set forth and when the relay coil means K1A is subsequently deenergized, the relay contact means K1B open (the relay contact means K1C not being utilized in the systems 20 and 33 of this invention).

The flame sense control portion 60 of the electrical circuit means 34 is substantially identical to the ignition trial portion 59 in that a transistor Q9 in a cycling manner connects and disconnects a lead means 68 for a gate 3 of a field effect transistor Q6 to ground and not to ground so that if the flame sensor or probe 57 is sensing flame at the pilot burner means 23, a negative voltage created through flame rectification will be applied from probe 57 through lead means 55, a lead means 69 and a lead means 70 to the gate 3 of the transistor Q6 and be taken away from the gate 3 of the transistor Q6 in a cycling manner to cause the transistor Q6 to cycle a SCR Q5 on and off and thus allow the relay coil K2A to be energized or pulled in in the same manner as the relay coil K1A previously described.

The pulling in or energizing of the relay coil K2A will cause the relay contacts K2B to close and relay contacts K2C to open for a purpose hereinafter set forth.

Since the timing portion 58 of the electrical circuit means 34 initially applies the negative voltage to the gate 3 of the transistor Q3 through the line 67 in a manner hereinafter set forth and should the flame sense control portion 60 sense a flame at the pilot burner means 23 to terminate the operation of the timer portion 58 as will be apparent hereinafter so as to terminate a signal in the lead means 67 from the timer portion 58, the flame sense control portion 60 has one side of the relay coil K2A interconnected by a diode D25 and through a resistor R14 to the lead 67 for the gate 3 of the transistor Q3 by a lead means 71. In this manner, a feedback of negative voltage is taken from the relay coil K2A and fed back to the gate 3 of the transistor Q3 so that as long as there is a flame sense, the negative voltage across the relay coil K2A will maintain the relay coil K1A energized so as to maintain pilot gas flow to the pilot burner means 23.

The ignition portion 61 of the electrical circuit means 34 comprises an auto transformer T2 that will generate about 120 volts output when 24 volts are applied to its primary and that occurs when the power lead means 41 is interconnected to a lead means 72 by the closing of the relay contact means K1B. This voltage from the auto transformer T2 is utilized to supply voltage to a capacitor C1 and when this voltage across the capacitor C1 charges up to a level of about 105 volts DC, a breakover device Q1 turns on and becomes a short circuit causing the capacitor C1 to discharge through the primary coil 73, terminals 3 and 4, of the high voltage transformer T1. This transforms over to the secondary coil 54 and generates a high voltage ignition spark across the gap 51 of the electrodes 50 and 52 to attempt to light fuel issuing from the pilot burner means 23 which has its control valve means 25 opened as the closing of the relay contacts K1B has energized the coil 39. If the fuel issuing from the pilot burner means 23 does light, then the flame sense control portion 60 will sense such flame in the manner previously set forth and energize the relay coil K2A which closes normally open relay contact means K2B to energize the main fuel value means coil 40 to open the main valve means 28 so that fuel can issue out of the main burner means 26 to be ignited by the flames at the pilot burner means 23 in a manner well known in the art.

When the relay contacts K2B close, voltage is supplied to a voltage divider R3 and R7, FIG. 2C, that turns a SCR Q2 on. When the SCR Q2 is turned on, the lower part of a voltage divider R1 and R2 is essentially tied to ground because of a ground lead means 43' of the ignition portion 61 so as to form a voltage divider which prevents 105 volts from ever building up to be able to trigger Q1. Thus, this in effect, is a turning off of the sparking at the electrodes 50, 52 when the main burner valve means 28 has been pulled in and is delivered fuel to the main burner means 26.

Therefore, the injection portion 61 of the electrical circuit means 34 when having voltage applied to the auto transformer T2, charges up the capacitor C1 and breaks over at the breakover device Q1 to get spark across the gap 51 and such sparking continues at a certain rate, such as sparking across the gap 51 four times a second, until flame is actually sensed by the probe 57 to cause the main valve means 28 to pull in and energize the SCR Q2 to stop such sparking.

The timer portion 58 of the electrical circuit means 34 has a lead means 73 interconnected to a diode D15 which leads to the trial time resistor means R9. Similarly, a lead means 74 of the timer portion 58 of the electrical circuit means 34 interconnects to the wait time resistor means R8 through a diode D14, the resistors R8, R9 and R10 each being interconnected to the lead means 65 that leads to the positive side of the capacitor C13 through the resistor R21.

Diodes D11, D9, D7 and D5 of the timer portion 58 of the electrical circuit means 34 respectively interconnect the outputs Q1, Q3, Q5 and Q7 of the counter U1 to the lead means 73 while the diodes D10, D8, D6, D4 and D3 respectively interconnect the outputs Q2, Q4, Q6, Q8 and Q9 of the .counter U1 to the diode D14.

The lead means 65 of the timer portion 58 of the electrical circuit means 34 is interconnected to the discharge port 7 of the timer U2 by a lead means 65' and the output port 3 of the timer U2 is interconnected by a lead means 75 to the input 13 of the counter U1 whereby each time the capacitor C13 discharges the timer U2, the timer U2 through the output port 3 thereof and lead means 75 clocks the counter U1 to cause the same to go to the next output port thereof as will be hereinafter set forth, the counter U1 resetting to the output port Q0 thereof each time current is removed from the input 14 thereof and then reapplied in a manner well known in the art.

Therefore, with the electrical circuit means 34 disposed in the condition illustrated in the drawings and then the thermostat 29 closes, the switchblade 30 applies 24 volts to the terminal E7 which can be called the transformer hot terminal. The 24 volts is applied through the normally closed relay contact means K2C, lead means 47, lead means 64, diode D16, resistor means R12, lead means 64' and lead means 78 to the input port 14 of the counter U1 to activate the counter U1 and set it to apply an electrical signal out of the output Q0 thereof. In addition, when the voltage is applied to the counter U1 through lead means 78, the voltage causes two capacitors C2 and C3 to charge up and develop a voltage across resistor R6 which results in a reset pulse to make sure that the counter U1 starts its output at position Q0. The reason there are two capacitors C2 and C3 is for redundancy so that if one capacitor C2 or C3 opens, the other capacitor C3 or C2 will be sufficient to reset the counter U1 at the reset point 15 as illustrated. Thus, when the counter U1 has been reset, the voltage appearing at the input point 14 will be applied by the counter U1 out of the output Q0 thereof in a manner hereinafter set forth.

The 24 volts that is applied through the diode D16 is applied across a capacitor C9, FIG. 2D, that is interconnected to the lead means 64 by a lead means 79. The voltage applied across capacitor C9 is applied through the resistor R12 in line 64 and develops a regulated voltage across a zener diode Z1 in a lead means 80 and this regulated voltage is approximately 12 volts. This regulated voltage is applied to the port 14 of the counter U1, to the timer U2 and to the collector 3 of a transistor Q7 by a lead means 80'.

When the counter U1 is set at the output Q0 thereof by the initial closing of the thermostat 29, voltage is applied by the output Q0 of the counter U1 through the diodes D12 and D13 to one end of the prepurge resistor means R10. This resistor means R10 is used only once during the entire time that the thermostat 29 is closed on a cycle thereof, i.e., each time the thermostat 29 closes, the resistor means R10 will only be utilized once as long as that thermostat 29 remains closed in that one cycle thereof.

The resistor means R10 is a prepurge resistor means and if the system 20 is to be a nonprepurge system, the resistance value of the resistor R10 is very low so as to permit the capacitor C13 through line 65 to charge up very fast so that there is virtually no wait time provided by a low resistor means R10. However, if the system 20 is to be a prepurge system, then the value of the resistor R10 could be relatively large so as to cause the charging up of the capacitor C13 to be a relatively long time, such as 30 seconds, in order to provide a 30-second prepurge option time period for the system 20. At the end of the 30-second charging time for the capacitor C13, the capacitor C13 will have reached its fully charged condition and then breakover so that the timer U2 will trigger because the discharge port 7 of the timer U2 is interconnected to the lead means 65 adjacent the juncture with the resistor R21 that leads to the positive side of the capacitor C13. When the timer U2 is triggered by the breaking over of the capacitor C13, the timer U2 through the lead means 75 momentarily grounds the port 13 of the counter U1 which takes the voltage off of the output Q0 and applies it to the output Q1. Simultaneously, the timer U2 discharges the capacitor C13 so it will be set to start to recharge from a lower charged level or condition thereof.

When the counter U1 has the voltage clocked to the output Q1 thereof, that voltage at the output Q1 is applied through diode D11 and lead means 73 to the anode of the diode D15 and goes through the diode D15 to one end of the resistor means R9 which has its other end interconnected to the lead means 65 to again cause the capacitor C13 to begin charging thereof. This charging of the capacitor C13 is to provide a first trial time period for attempting ignition at the pilot burner means 23. In general, this trial for ignition period is normally kept below a 90-second maximum but any time period can be provided depending upon the selection of the value of the resistor R9.

During this first ignition trial time, it can be seen that the voltage applied to the line means 73 through the diode D11 from the output Q1 of the counter U1 is also applied through a diode D23 and a resistor R18 in a lead means 81 to the base 2 of the transistor Q7. Previously, when the thermostat 29 initially closed, the capacitor C10 was charged up through a diode D32, resistor R19, a diode 27, lead means 80', lead means 80 and lead means 64 to approximately 12 volts, which is the voltage of the zener diode Z1 minus a couple of diode drops. As soon as the transistor Q7 is turned on by having the voltage applied to the base 2 thereof, the positive terminal of the capacitor C10 is grounded so that a voltage is fed into resistor R23 in lead means 67 which is negative as opposed to ground so that the voltage going into the gate 3 of the transistor Q3 is a negative voltage because of the fact that the system charged the capacitor C10 up and proved that it could be charged and then the turning on of the transistor Q7 causes the capacitor C10 to discharge through the voltage divider R23, R27 and apply negative voltage to the gate 3 of the transistor Q3. As previously described, when a negative voltage is applied to the gate 3 of transistor Q3 and the transistor Q8 is turned on and off by the AC signal applied thereto from lead means 66, current will flow through the coil K1A and thereby pull in the pilot valve 25 so that the pilot valve 25 will permit fuel to flow from the source conduit 24 out of the pilot burner means 23.

In particular, at the same time that the current flows through the coil K1A, the energized coil K1A causes the normally opened relay contact means K1B to close to cause the pulling in of the pilot burner valve 25 in the manner previously described and to apply voltage to the auto transformer T2 through the line 72 which causes sparking across the gap 51 of the electrode 50 and 52 also in the manner previously set forth.

The timer U2 is so constructed and arranged that when the voltage on pin 6 thereof becomes equal to two-thirds of the applied voltage, the timer U2 will turn on. As the voltage is applied to the positive side of the capacitor C13, the capacitor C13 will charge and it will charge at a time rate determined by the resistance R10, R9 or R8 that is in series with the capacitor C13. When the charge on the capacitor C13 gets to two-thirds of the applied voltage, which in this case is 8 volts that has been determined by the zener diode Z1 which is a 12 volt zener diode so that two-thirds of 12 is 8 volts, the capacitor causes the timer U2 to turn on.

When the capacitor C13 reaches 8 volts and turns on the timer U2, the turned on timer U2 rapidly discharges the capacitor C13 through the 100 ohm resistor R21 and momentarily grounds the lead means 65. When capacitor C13 gets discharged to a point of one-third of the applied voltage, which is 4 volts in this case, the capacitor C13 turns the timer U2 back on and allows it to retime. In the meantime, the output of the timer U2, which is the pin 3 thereof, is momentarily dropped to ground and this ground signal is put into the pin 13 of the counter U1 which is the not clock input. In other words, when the timer U2 thus triggers the counter U1, it changes its output from one output to a different output.

However, if during this first trial ignition period the sparking at the spark gap 51 does ignite the fuel issuing from the pilot burner means 23, the probe 57 senses such flame and through flame rectification causes a negative voltage to be applied to the gate 3 of the transistor Q6 which is cycled on and off by the transistor Q9 so as to cause the relay coil K2A to be energized. This energizing of the relay coil K2A causes the normally closed relay contacts K2C to open and the normally open relay contacts K2B to close. The opening of the relay contacts K2C terminates the supply of electrical power through the lead means 47 to the timer portion 58 of the electrical circuit means 34 and not only turns off the timer U2 and the counter U1, but also removes the charging of the capacitor C10 so that the energizing of the relay coil K1A would cease. However, because of the feedback of negative voltage from the now energized relay coil K2A through diode D25, lead means 71 and resistor R14, the negative voltage remains on the gate 3 of the transistor Q3 so that the continuing to turn on and off transistor Q8 maintains the energization of the relay coil K1A and, thus, the continuing of the fuel to flow out of the pilot burner means 23. The energizing of the coil K2A pulls in the main burner valve means 28 because the now closed relay contact means K2B interconnects the power source lead means 44 to the coil 40 of the control unit 38 whereby the main valve means 28 interconnects the fuel source conduit 27 to the main burner means 26. The flow of fuel from the main burner means 26 will now be ignited by the flames from the now continuously operating pilot burner means 23.

Also, when the relay coil K2A is energized and closes the relay contact means K2B, the closed contact means K2B supplies voltage to the voltage divider R3 and R7 which turns on the SCR Q2. When the SCR Q2 is turned on, the voltage divider R1 and R2 is now connected to the ground lead 43' through the turned on SCR Q2 which prevents 105 volts from ever building up again to trigger off Q1 so that no further sparking will take place at the spark gap 51 during the time the relay coil K2A is energized.

In this manner, the coils K1A, K2, 39 and 40 remain energized as long as the probe 57 continues to sense flame whereby the timer portion 58, the trial ignition portion 59 and the ignition portion 61 of the electrical circuit means are effectively turned off to be ready for a new cycle of operation thereof once the thermostat 29 subsequently opens after being heat satisfied and then recloses on a demand for heat.

However, assume that during the first trial time period previously described that the gas issuing from the pilot burner means 23 does not ignite. Therefore, the capacitor C13 is continuing to be charged under the control of the resistor R9 until it is charged to its 8 volt point. At this time, the capacitor C13 discharges the timer U2 which in turn not only dumps the charge on the capacitor C13 to about 4 volts, but also the timer U2 temporarily grounds the input port 13 of the counter U1 to cause the same to change to its output Q2 which removes the voltage from the lead means 73 and places it on the lead means 74 through the diode D10. Thus, the voltage is removed from the line 81 and, thus, from the base or gate 2 of the transistor Q7 so that the transistor Q7 turns off and immediately causes the capacitor C10 to recharge so the voltage is removed from the gate 3 of the transistor Q3 to remove the current from the relay coil K1A and, thus, close the pilot gas valve 25 so that fuel ceases to flow from the pilot burner 23. The removal of current from the relay coil K1A causes the contacts K1B to reopen and remove the voltage from the auto transformer T2 to thereby stop sparking at the spark gap 51.

Thus, the timer portion 58 of the electrical circuit means 34 is in the first wait time period thereof wherein the voltage being applied by the diode D10 in the lead means 74 is fed through the diode D14 and resistor R8 to cause the capacitor C13 to begin to charge up from its previously discharged condition of 4 volts to the trigger voltage of 8 volts, this time period being determined by the value of the resistance R8. This wait period can be any desired time period depending upon the value of the resistor R8, such as even up to thirty minutes whereas some furnace manufacturers would only like a five-minute wait period which can be provided with the proper rated resistor R8.

In any event, the capacitor C13 is being slowly charged up to the 8 volt value thereof so that when the same again breaks over, it discharges or triggers the timer U2 which dumps the voltage on the capacitor C13 and causes the counter U1 to clock its output from the output Q2 to the output Q3 so as to remove the voltage on the lead means 74 and now place the voltage back on the lead means 73 through the diode D9. The voltage on the lead means 73 is again applied through the diode D15 and the resistor R9 as well as through the line 81 so as to cause the capacitor C13 to begin to charge up again in relation to the time provided by the resistor R9 and to cause the transistor Q7 to close and again apply negative voltage to the gate 3 of the transistor Q3 which is cycled on and off by the transistor Q8 and thereby cause the relay coil K1A to be energized and again start gas flowing from the pilot burner means 23 and sparking to occur at the gap 51 in the manner previously described during this second trial time ignition period.

If flame is created at the pilot burner means 23 during the second trial period, the flame sense control portion 60 of the electrical circuit means 34 will cause the main burner means 26 to pull in to have the fuel issuing from the main burner means 26 and be ignited by the flames of the pilot burner means 23 and terminate the operation of the timer portion 58, the ignition trial portion 59 and the ignition portion 60 of the electrical circuit means 34 in the manner previously described.

However, if ignition of the pilot burner 23 during this second trial time does not take place, the capacitor C13 eventually again triggers the timer U2 which clocks the counter U1 to remove the voltage from the lead means 73 and again place the voltage on the lead means 74 through the output Q4 and diode D8 so as to provide for voltage through the wait time resistor means R8 for another wait time period before again attempting ignition.

Thus, it can be seen with the timing sequence circuit of the timing portion 58 illustrated in the drawings, there can be up to four trial times for ignition with intervening wait periods and then after the fourth trial time the voltage is applied by output Q8 of the counter U1 through the diode D4 to provide for a wait time period and then after that wait time, the timer U2 causes the counter U1 to apply the voltage from the output Q9 through the diode D3 and, thus, back through the diode D14 for another wait time before clocking back to the output Q1 to restart the ignition cycles in a continuous operation as long as the thermostat 29 remains closed in the one cycle thereof.

Thus, it can be seen that the timer portion 58 of the electrical circuit means 34 can be set to have on each cycle of operation of the thermostat 29 a prepurge time period as determined by a high value of the resistor R10 or substantially no prepurge time as determined by a low value of the resistor R10 and that such prepurge or nonprepurge use of the resistor R10 only occurs at the start of the closing cycle of operation of the thermostat 29 and then thereafter the series of diodes D11–D3 is utilized if there is no flame sense at the pilot burner means 23 during any of the trial times for ignition and the thermostat 29 is not opened with the cycle of operation returning back to the diode D11 after the counter U1 has been clocked to Q9 in the second wait period after the fourth ignition trial period.

Accordingly, a prepurge time of one to thirty seconds can be provided through the proper selection of the resistor means R10 for the system 20, a 300K ohms resistor means R10 for thirty seconds and a 10K ohms resistor means R10 for one second. Four trials for ignition can be provided with a maximum time for each ignition being approximately ninety seconds through the proper selection of the value of the resistor means R9 utilized for the system 20, a 600K ohms resistor means R9 for sixty seconds. Between each trial for ignition there is a wait or interpurge time that can be any time up to thirty minutes at room temperature by selecting the proper value for the resistor R8 for the system 20. After every fourth try for ignition, or after the try for ignition in a certain sequence thereof, there is an additional wait time and this wait time can have an absolute time of thirty minutes, an eighteen megohm resistor means R8 for thirty minutes. This double wait time occurs because capacitor 13 is charged through the resistor means 8, the diode D14, the diode D4 and the output Q8 of the counter U1 and then the timer U2 causes the counter U1 to be clocked to the output Q9 thereof for supplying charging voltage through diodes D3 and D14 to the resistor means R8. The maximum size of the resistor means is 18 megohms to provide for the maximum time of thirty minutes. This gives a total wait time of approximately sixty minutes after every fourth try or the last try for ignition in the cycle thereof which is an absolute maximum. If shorter wait times are desired between attempts with a long time after the fourth attempt, diode D3 may be replaced by a resistor for a maximum time of thirty minutes. The value of the replacing resistor may not exceed 18 megohms minus the value of the resistor means R8.

If it is desired that after the four tries for ignition a lockout of the system is to be provided, then the diodes D3 and D4 are removed so that when the timer U2 clocks the counter U1 from the output Q7 at the end of the fourth ignition trial time to go to output Q8, there is no longer a recharging of the capacitor C13 so the electrical circuit means 34 will remain in a dormant condition until the thermostat 29 is moved to an open condition and then returned back to a closed condition to remove the system from such lockout.

Should it be desired to have a lockout after three tries for ignition, then the diodes D3, D4, D5 and D6 are removed. Should it be desired to have lockout after two ignition tries, the diodes D3, D4, D5, D6, D7 and D8 are removed. If it is desired to have lockout after one try for ignition, then diodes D3, D4, D5, D6, D7, D8, D9 and D10 are removed.

It can be seen that all values for the various components of the fuel control system 20 of this invention are given on the drawings with all resistor values being in ohms, 0.25 wattplus/minus 5%; all capacitor tolerances are 10% or 20% with voltage ratings between 25 and 250 volts DC; and all nonzener diodes are 1N4148 and 1N4004 types.

Should it be desired to utilize the system 20 with local sense, i.e. using the sparking probe 50 also as the sense probe, the remote sense probe 57, the terminal E2, the resistor R4 and the jumper W1 are removed from the system 20 and the resistor R5 and the varistor VT1 are inserted therein in the manner illustrated by the box 63. The option of having a remote sense or a local sense is well known in the art as evidenced by the aforementioned U.S. patents to Geary.

The capacitor C20 which is attached to pin 7 of the timer U2 is utilized to bypass sparks which would cause a miscount. The capacitor C15 is also in the circuit means for the same reason, i.e. to help bypass sparks.

The capacitor C16 is a dual purpose capacitor. It tends to prevent miscount or mistime on the timing circuits and it is also utilized as a load resistor as the capacitive reactance of this capacitor C16 is around 560 ohms.

The electrical circuit means 34 can have jacks J1, FIG. 2A, so that if the resistor means R10 is utilized for a prepurge time period in the system 20, a person testing the circuit means 34 can short out the resistor R10 to a desired shorter prepurge time as provided by a resistor R11, such as two seconds, so that the tester will know that the control does have prepurge but one does not have to wait for the full thirty seconds to prove that.

Also, test points TP1, TP2, TP3 and TP5, FIG. 2A, are provided in the electrical circuit means 34 for factory testing so that these points can be probed with predetermined resistors to provide fast test times so as not to wait for the various times provided by the resistors R8, R9 and R10.

Therefore, it can be seen that it is a relatively simple method of this invention to make the heat exchanger control system 20 as well as the fuel control system 33 thereof that will uniquely operate in the manner previously set forth.

Thus, this invention not only provides a new heat exchanger control system and a new fuel control system for such a heat exchanger system, but also this invention provides a new method of making such a heat exchanger system and such a fuel control system.

While the forms and methods of this invention now preferred have been illustrated and described as required by the Patent Statue, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a fuel control system for a heat exchanger system that comprises a thermostat, a pilot burner means, a main burner means, and electrically operated igniter means for igniting fuel that issues from said pilot burner means, said pilot burner means when ignited being adapted to ignite fuel that issues from said main burner means, said fuel control system comprising electrical circuit means that comprises an ignition trail portion for operating said igniter means, a flame sense control portion for operating said pilot burner means and said main burner means, and a timer portion adapted on each cycle of a closing of said thermostat and before the next opening thereof to cause said ignition trial portion to tend to operate said igniter means for a first certain period of trial time, said flame sense control portion being adapted to terminate said operation of said igniter means during said first certain period of trial time if said flame sense portion senses that fuel issuing from said pilot burner means has been ignited, said timer portion being adapted to terminate the operation of said igniter means upon the termination of said first certain period of trial time if no flames appear at said pilot burner means and to provide a first certain period of wait time before causing said ignition trial portion to tend to operate said igniter means for a second certain period of trial time during that said cycle, said flame sense control portion being adapted to terminate said operation of said igniter means during said second certain period of trial time if said flame sense control portion senses that fuel issuing from said pilot burner means has been ignited, the improvement wherein said timer portion comprises a counter having a plurality of outputs and a timer that cocks the output of said counter on each discharge of said timer, a capacitor for causing said timer to discharge and discharge said capacitor to a discharged condition thereof upon each charging of said capacitor to a certain voltage, trial time resistor means, and wait time resistor means, said counter when clocked to a first output thereof by said timer being adapted to place said trial time resistor means and said capacitor in series at the start of said first trial time period so that said trial time resistor means determines the time period said capacitor charges from its said discharged condition to said certain voltage thereof and that time period comprises said first certain trial time period, said counter when clocked to a second output thereof by said timer being adapted to place said wait time resistor means and said capacitor in series at the start of said wait time period so that said wait time resistor means determines the time period said capacitor charges from said discharged condition thereof to said certain voltage thereof and that time period comprises said wait time period, said counter when clocked to a third output thereof by said timer being adapted to place said trial time resistor means and said capacitor in series at the start of said second trial time period so that said trial time resistor means determines the time period said capacitor charges from its said discharged condition to said certain voltage thereof and that time period comprises said second certain trial time period.

2. A fuel control system as set forth in claim 1 wherein said timer portion comprises prepurge time resistor means, said counter when reset to its starting position upon the initial closing of said thermostat in that said cycle thereof being adapted to place said prepurge time resistor means and said capacitor means in series so that said prepurge time resistor means determines the time period said capacitor charges from its previous condition to said certain voltage thereof to cause said timer to then clock to said first output thereof.

3. A fuel control system as set forth in claim 1 wherein said timer portion is adapted to terminate the operation of said second certain period of trial time if no flames appear at said pilot burner means and to provide a second certain period of wait time before causing said ignition trial portion to tend to operate said igniter means for a third certain period of trial time during that said cycle, said flame sense control portion being adapted to terminate said operation of said igniter means during said third certain period of trial time if said flame sense control portion senses that fuel issuing from said pilot burner means has been ignited.

4. A fuel control system as set forth in claim 3 wherein said timer portion is adapted to terminate the operation of said igniter means upon the termination of said third certain period of trial time if no flames appear at said pilot burner means and to provide a third certain period of wait time before causing said ignition trial portion to tend to operate said igniter means for a fourth certain period of trial time during that said cycle, said flame sense control portion being adapted to terminate said operation of said igniter means during said fourth certain period of trial time if said flame sense control portion senses that fuel issuing from said pilot burner means has been ignited.

5. A fuel control system as set forth in claim 4 wherein said timer portion is adapted to terminate the operation of said igniter means upon the termination of said fourth certain period of trial time if no flames appear at said pilot burner means and to provide a fourth certain period of wait time before causing said ignition trial portion to tend to again operate said igniter means for said first certain period of trial time during that said cycle, said fourth certain period of wait time being approximately twice as long as any one of said first and second and third certain periods of wait time.

6. In a heat exchanger system comprising a thermostat, a pilot burner means, a main burner means, electrically operated igniter means for igniting fuel that issues from said pilot burner means, said pilot burner means when ignited being adapted to ignite fuel that issues from said main burner means, and a fuel control system comprising electrical circuit means that comprises an ignition trial portion for operating said igniter means, a flame sense control portion for operating said pilot burner means and said main burner means, and a timer portion adapted on each cycle of a closing of said thermostat and before the next opening thereof to cause said ignition trial portion to tend to operate said igniter means for a first certain period of trial time, said flame sense control portion being adapted to terminate said operation of said igniter means during said first certain period of trial time if said flame sense portion senses that fuel issuing from said pilot burner means has been ignited, said timer portion being adapted to terminate the operation of said igniter mans upon the termination of said first certain period of trial time if no flames appear at said pilot burner means and to provide a first certain period of wait time before causing said ignition trial portion to tend to operate said igniter means for a second certain period of trial time during that said cycle, said flame sense control portion being adapted to terminate said operation of said igniter means during said second certain period of trial time if said flame sense control portion senses that fuel issuing from said pilot burner means has been ignited, the improvement wherein said timer portion comprises a counter having a plurality of outputs and a timer that clocks the output of said counter on each discharge of said timer, a capacitor for causing said timer to discharge and discharge said capacitor to a discharged condition thereof upon each charging of said capacitor to a certain voltage, trial time resistor means, and wait time resistor means, said counter when clocked to a first output thereof by said timer being adapted to place said trial time resistor means and said capacitor in series at the start of said first trial time period so that said trial time resistor means determines the time period said capacitor charges from its said discharged condition to said certain voltage thereof and that time period comprises said first certain trial time period, said counter when clocked to a second output thereof by said timer being adapted to place said wait time resistor means and said capacitor in series at the start of said wait time period so that said wait time resistor means determines the time period said capacitor charges from said discharged condition thereof to said certain voltage thereof and that time period comprises said wait time period, said counter when clocked to a third output thereof by said timer being adapted to place said trial time resistor means and said capacitor in series at the start of said second trial time period so that said trial time resistor means determines the time period said capacitor charges from its said discharged condition to said certain voltage thereof and that time period comprises said second trial time period.

7. A heat exchanger system as set forth in claim 6 wherein said timer portion comprises a prepurge time resistor means, said counter when reset to its starting position upon the initial closing of said thermostat in that said cycle thereof being adapted to place said prepurge time resistor means and said capacitor means in series so that said prepurge time resistor means determines the time period said capacitor charges from its previous condition to said certain voltage thereof to cause said timer to then clock to said first output thereof.

8. A heat exchanger system as set forth in claim 7 wherein said timer portion is adapted to terminate the operation of said igniter means upon the termination of said second certain period of trial time if no flames appear at said pilot burner means and to provide a second certain period of wait time before causing said ignition trial portion to tend to operate said igniter means for a third certain period of trial time during that said cycle, said flame sense control portion being adapted to terminate said operation of said igniter means during said third certain period of trial time if said flame sense control portion senses that fuel issuing from said pilot burner means has been ignited.

9. A heat exchanger system as set forth in claim 8 wherein said timer portion is adapted to terminate the operation of said igniter means upon the termination of said third certain period of trial time if no flames appear at said pilot burner means and to provide a third certain period of wait time before causing said ignition trial portion to tend to operate said igniter means for a fourth certain period of trial time during that said cycle, said flame sense control portion being adapted to terminate said operation of said igniter means during said fourth certain period of trial time if said flame sense control portion senses that fuel issuing from said pilot burner means has been ignited.

10. A heat exchanger system as set forth in claim 9 wherein said timer portion is adapted to terminate the operation of said igniter means upon the termination of said fourth certain period of trial time if no flames appear at said pilot burner means and to provide a fourth certain period of wait time before causing said ignition trial portion to tend to again operate said igniter means for said first certain period of trial time during that said cycle, said fourth certain period of wait time being approximately twice as long as any one of said first and second and third certain periods of wait time.

11. In a method of making a fuel control system for a heat exchanger system that comprises a thermostat, a pilot burner means, a main burner means, and electrically operated igniter means for igniting fuel that issues from said pilot burner means, said pilot burner means when ignited being adapted to ignite fuel that issues from said main burner means, said fuel control system comprising electrical circuit means that comprises an ignition trial portion for operating said igniter means, a flame sense control portion for operating said pilot burner means and said main burner means, and a timer portion adapted on each cycle of a closing of said thermostat and before the next opening thereof to cause said ignition trial portion to tend to operate said igniter means for a first certain period of trial time, said flame sense control portion being adapted to terminate said operation of said igniter means during said first certain period of trial time if said flame sense portion senses the fuel issuing from said pilot burner means has been ignited, said timer portion being adapted to terminate the operation of said igniter means upon the termination of said first certain period of trial time if no flames appear at said pilot burner means and to provide a first certain period of wait time before causing said ignition trial portion to tend to operate said igniter means for a second certain period of trial time during that said cycle, said flame sense control portion being adapted to terminate said operation of said igniter means during said second certain period of trial time if said flame sense control portion senses that fuel issuing from said pilot burner means has been ignited, the improvement comprising the steps of forming said timer portion to comprise a counter having a plurality of outputs and a timer that clocks the output of said counter on each discharge of said timer, a capacitor for causing said timer to discharge and discharge said capacitor to a discharged condition thereof upon each charging of said capacitor to a certain voltage, trial time resistor means, and wait time resistor means, forming said counter when clocked to a first output thereof by said timer being adapted to place said trial time resistor means and said capacitor in series at the start of said first trial time period so that said trial time resistor means determines the time period said capacitor charges from its said discharged condition to said certain voltage thereof and that time period comprises said first certain trial time period, forming said counter when clocked to a second output thereof by said timer being adapted to place said wait time resistor means and said capacitor in series at the start of said wait time period so that said wait time resistor means determines the time period said capacitor charges from said discharged condition thereof to said certain voltage thereof and that time period comprises said wait time period, and forming said counter when clocked to a third output thereof by said timer being adapted to place said trial time resistor means and said capacitor in series at the start of said second trial time period so that said trial time resistor means determines the time period said capacitor charges from its said discharged condition to said certain voltage thereof and that time period comprises said second certain trial time period.

12. In a method of making a heat exchanger system that comprises a thermostat, a pilot burner means, a main burner means, and electrically operated igniter means for igniting fuel that issues from said pilot burner means, said pilot burner means when ignited being adapted to ignite fuel that issues from said main burner means, said fuel control system comprising electrical circuit means that comprises an ignition trial portion for operating said igniter means, a flame sense control portion for operating said pilot burner means and said main burner means, and a timer portion adapted on each cycle of a closing of said thermostat and before the next opening thereof to cause said ignition trial portion to tend to operate said igniter means for a first certain period of trial time, said flame sense control portion being adapted to terminate said operation of said igniter means during said first certain period of trial time if said flame sense portion senses that fuel issuing from said pilot burner means has been ignited, said timer portion being adapted to terminate the operation of said igniter means upon the termination of said first certain period of trial time if no flames appear at said pilot burner means and to provide a first certain period of wait time before causing said ignition trial portion to tend to operate said igniter means for a second certain period of trial time during that said cycle, said flame sense control portion being adapted to terminate said operation of said igniter means during said second certain period of trial time if said flame sense control portion senses the fuel issuing from said pilot burner means has been ignited, the improvement comprising the steps of forming said timer portion to comprise a counter having a plurality of outputs and a timer that clocks the output of said counter on each discharge of said timer, a capacitor for causing said timer to discharge and discharge said capacitor to a discharged condition thereof upon each charging of said capacitor to a certain voltage, trial time resistor means, and wait time resistor means, forming said counter when clocked to a first output thereof by said timer being adapted to place said trial time resistor means and said capacitor in series at the start of said first trial time period so that said trial time resistor means determines the time period said capacitor charges from its said discharged condition to said certain voltage thereof and that time period comprises said first certain trial time period, forming said counter when clocked to a second output thereof by said timer being adapted to place said wait time resistor means and said capacitor in series at the start of said wait time period so that said wait time resistor means determines the time period said capacitor charges from said discharged condition thereof to said certain voltage thereof and that time period comprises said wait time period, and forming said counter when clocked to a third output thereof by said timer being adapted to place said trial time resistor means and said capacitor in series at the start of said second trial time period so that said trial time resistor means determines the time period so that said trial time resistor means determines the time period said capacitor charges from its said discharged condition to said certain voltage thereof and that time period comprises said second certain trial time period.

* * * * *